US006406094B2

(12) United States Patent
Lohness et al.

(10) Patent No.: US 6,406,094 B2
(45) Date of Patent: Jun. 18, 2002

(54) COMBINATION STIFFENER AND GANGER BRACKET FOR CHAIR

(75) Inventors: William F. Lohness, Jonesville; R. Duane Ware, Temperance, both of MI (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 33 days.

(21) Appl. No.: 09/923,575

(22) Filed: Aug. 7, 2001

Related U.S. Application Data

(63) Continuation of application No. 09/532,979, filed on Mar. 22, 2000.

(51) Int. Cl.[7] ..... A47C 1/124

(52) U.S. Cl. ..... 297/248; 297/234; 297/249; 248/200

(58) Field of Search ..... 297/248, 239, 297/249; 248/200

(56) References Cited

U.S. PATENT DOCUMENTS

| | | | | | |
|---|---|---|---|---|---|
| 2,956,618 | A | | 10/1960 | Eames et al. | 155/130 |
| 3,018,131 | A | * | 1/1962 | Krueger | 297/248 |
| 3,084,977 | A | | 4/1963 | Chapman | 297/239 |
| 3,123,399 | A | | 3/1964 | Wilson | 297/239 |
| 3,127,218 | A | * | 3/1964 | Banke | 297/248 |
| 3,133,762 | A | | 5/1964 | Newman | 297/239 |
| 3,159,425 | A | | 12/1964 | Engstrom | 297/248 |
| 3,174,795 | A | * | 3/1965 | Chapman et al. | 297/160 |
| 3,227,487 | A | * | 1/1966 | Blanchard, Jr. et al. | 297/248 |
| 3,291,523 | A | * | 12/1966 | Krueger | 297/239 |
| 3,314,718 | A | * | 4/1967 | Crandall | 297/239 |
| 3,328,075 | A | | 6/1967 | Albinson | 297/239 |
| 3,614,157 | A | | 10/1971 | Hendrickson et al. | 297/248 |
| 3,620,567 | A | | 11/1971 | Hendrickson et al. | 297/248 |
| 3,695,694 | A | | 10/1972 | Mohr | 297/248 |
| 3,697,130 | A | | 10/1972 | Barecki et al. | 297/248 |
| 3,758,155 | A | | 9/1973 | Straits | 297/248 |
| 3,827,749 | A | | 8/1974 | Johnson et al. | 297/248 |
| 4,154,476 | A | | 5/1979 | Blodee | 297/248 |
| 4,386,804 | A | | 6/1983 | Ware et al. | 297/248 |
| 4,400,031 | A | | 8/1983 | DeDecker | 297/239 |
| 4,655,504 | A | * | 4/1987 | Weber | 297/239 |
| 5,002,337 | A | | 3/1991 | Engel et al. | 297/239 |
| 5,282,669 | A | | 2/1994 | Barile | 297/248 |
| D363,658 | S | * | 10/1995 | Barile | D8/382 |
| 5,863,096 | A | | 1/1999 | Bartimae | 297/248 |
| 5,957,530 | A | | 9/1999 | Gutgsell | 297/248 |

* cited by examiner

*Primary Examiner*—Anita King
*Assistant Examiner*—Steven Marsh
(74) *Attorney, Agent, or Firm*—Gifford, Krass, Groh, Sprinkle, Anderson & Citkowski, P.C.

(57) ABSTRACT

A combination stiffener and ganger bracket is designed for a stackable chair of the type having a generally horizontal seating surface and four downwardly extending legs. The bracket has a generally planar body with an attachment tab at both of its ends. Two edges of the bracket extend between the ends of the bracket. A hook member extends from one of the edges while an engagement tab extends from the other edge. A stacking tab projects from the plane of the body.

22 Claims, 3 Drawing Sheets

COMBINATION STIFFENER AND GANGER BRACKET FOR CHAIR

This Appln is a con't of Ser. No. 09/532,979 filed Mar. 22, 2000.

FIELD OF THE INVENTION

The present invention relates generally to a bracket for chairs and, more specifically, to a combination stiffener and ganger bracket.

BACKGROUND OF THE INVENTION

Convention halls and auditoriums often use individual stackable chairs to provide additional seating during particular events. When not in use, these chairs are stacked and stored. When the chairs are unstacked and arranged for use, it is often desirable to arrange and interlock the chairs into straight rows. This may also be referred to as "ganging" the chairs. For this purpose, some chairs include ganger brackets for interlocking each chair with its immediately adjacent neighboring chair or chairs. Ganger brackets typically take the form of some type of hook extending from one side of the chair and a corresponding engagement loop or surface on the opposite side of the chair. Then, two identical chairs may be interlocked by the hook portion of one chair interlocking with the loop or surface of its neighboring chair.

A typical convention chair has a generally horizontal rectangular seating surface with a leg extending downwardly from each of the four corner of the seating surface. One common type of ganger bracket assembly includes a ganger hook bracket that extends between the front and back legs on one side of the chair. The bracket is generally a flat member with a downwardly turned upper edge. The downwardly turned upper edge gives the hook bracket a generally hooked-shaped cross section. Specifically, the hook bracket has a cross section that generally resembles an upside down letter J. The upper hook portion of the bracket extends outwardly from the flat surface and from the chair. The engagement bracket that forms the other part of the ganger bracket assembly is simply a generally flat member which extends from the front leg to the rear leg on the side of the chair opposite the hook bracket. Both the hook bracket and engagement bracket are positioned a few inches below the seating surface and generally horizontal.

In use, two chairs with the same ganger bracket assemblies are positioned side-by-side with the hook bracket of one immediately adjacent the engagement bracket of the other. One chair is then lifted slightly so that the hook portion attached thereto can pass over the top of the engagement bracket on the other chair. When the chair is set back down, the two brackets are interhooked so that the chairs are maintained immediately adjacent and parallel to one another.

The above described type of ganger assembly has several shortcomings. First, the hook assembly and the engagement bracket are different from one another, requiring production of two different pieces. Another shortcoming is that if one chair in a series of interlocked chairs is tilted backwardly, the chairs immediately adjacent do not necessarily tilt with it. Fire code for some applications requires that the chairs be more securely interlocked such that if one chair is tipped backwardly it neighboring chairs also tilt with it. Depending on the specific design of the hook bracket and engagement bracket, this design may also suffer from the shortcoming that immediately adjacent chairs may be positioned slightly forwardly or backwardly of one another. This reduces the neat appearance of a row of chairs. It is preferred that the chairs line up precisely with one another to give a very neat appearing row.

As stated previously, the chairs for use in convention halls and auditoriums are preferably stacked when not in use. There are many designs that allow chairs to be stacked one atop another in a space efficient manner. Typically, the front legs of each chair slope generally forwardly and the rear legs slope slightly rearwardly. One front and one rear leg are often interconnected as an inverted U-shaped piece of metal. One of these U-shaped pieces of metal is connected to each side of the seating surface, outboard of the seating surface. When the chairs are stacked, the seating surface of one chair is placed immediately on top of the seating surface of the chair below it with the outboard legs stacking atop one another. One problem with this design is that the U-shaped leg pair of one chair often becomes wedged on top of the U-shaped leg pair of the chair immediately below it. This makes it difficult to unstack the chairs. Therefore, manufacturers may include some type of stacking limiter that prevents one chair from moving too far downwardly on the chair below it. This may take the form of nubs or brackets extending inwardly from the inside of the U-shaped leg pair so that the brackets engage the top of the U-shaped leg pair of the chair immediately below. In this way, one U-shaped leg pair cannot push too far upwardly between the pair above it. A drawback to these stacking limiters is that they require an additional piece of material for each chair which increases assembly complexity and cost.

In light of the above, there remains a need for an improved ganger bracket wherein the hook bracket and the engagement bracket are identical pieces. Further, there is a need for a design that securely interlocks adjacent chairs, is easy to use, sturdy, and leads to neat alignment of adjacent chairs.

There is also a desire for a simpler stack limiter than those presently used. It would be highly beneficial to provide a ganger bracket that also acts as a stack limiter.

SUMMARY OF THE INVENTION

The present invention overcomes many of the shortcomings of the prior art be providing a combination stiffener and ganger bracket for a stackable chair. Specifically, the bracket is designed for the type of chair that has a generally horizontal seating surface with four corners and a leg extending downwardly from each of the corners. The bracket has a generally planar body with a first attachment tab at a first end and a second attachment tab at a second end opposite the first end. A hook member extends from a first edge of the body, with the first edge extending between the first and second ends. An engagement means is defined upon a second edge of the body, opposite the first edge. A stacking tab projects from the plane of the body.

DETAILED DESCRIPTION OF THE PREFERRED EMBODIMENTS

Figure 1:
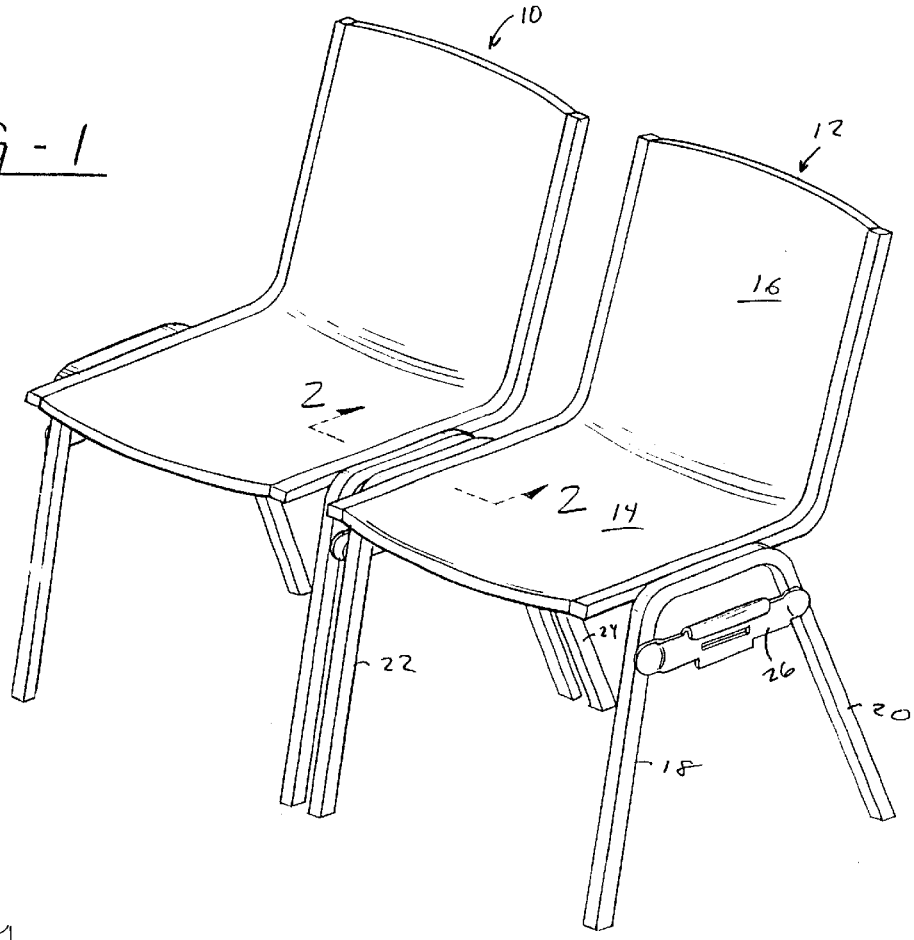
FIG. 1 is a perspective view of a pair of chairs interconnected by a pair of brackets according to the present invention.
Figure 2:
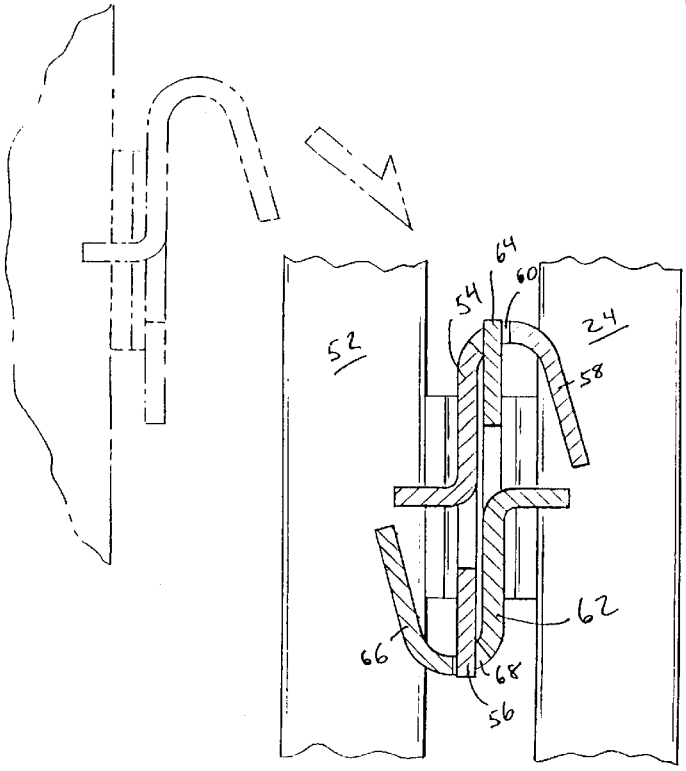
FIG. 2 is a cross-sectional view taken along lines 2—2 of FIG. 1, showing the pair of brackets interconnecting the chairs.

Referring first to FIGS. 1 and 2, two chairs 10 and 12 are shown positioned side by side and interlocked in that position by brackets according to the present invention. The chair 12 has a generally horizontal seating surface 14. A back 16 extends generally perpendicularly upwardly from the rear edge of the seating surface 14. The seating surface 14 may be said to have four corners. The seating surface 14 is supported by four legs which extend downwardly from the seating surface. The legs may be said to extend downwardly from the four corners of the seating surface, though, as shown, the legs may actually attach to the seating surface at a position somewhat removed from the absolute corners. For ease of later reference, the four legs may be defined as being a front left leg 18, a rear left leg 20, a front right leg 22, and a rear right leg 24. As known to those of skill in the art, the legs 18–24 may be individually connected to the frame of the chair or, as shown, some chairs are constructed by forming a U-shaped bracket that forms both a front and back leg. As shown, the front left leg 18 and the rear left leg 20 are integral with one another and are part of a generally U-shaped bent metal leg assembly. The other chair 10 has similar parts, though not enumerated.

A bracket 26 according to the present invention is shown extending between and interconnecting the front left leg 18 and the rear left leg 20. The bracket 26 is positioned generally horizontal, which places it generally parallel to the seating surface 14. As shown, the bracket 26 is positioned a short distance below the seating surface 14. Because the bracket 26 is positioned below and spaced from the seating surface 14, the bracket 26 acts to stiffen the legs to which it is interconnected. That is, the bracket 26 interconnects the front left leg 18 and the rear left leg 20 thereby stiffening the pair of legs and making them less likely to spread apart.

Referring now to FIGS. 5–8, the bracket 26 will be described in more detail. The bracket 26 comprises a generally planar body 28 that is somewhat elongated and has a first end 30 and a second end 32. A first edge 34 and a second edge 36 extend between the first 30 and second 32 ends of the body 28. A first attachment tab 38 is formed at the first end 30 of the planar body, and a second attachment tab 40 is formed at the second end 32 of the planar body 28. These attachment tabs 38 and 40 are designed to be attached, by welding or other means, to the legs of a chair. That is, one attachment tab is attached to the front leg and the other tab is attached to the rear leg on the same side of the chair.

Figure 5:
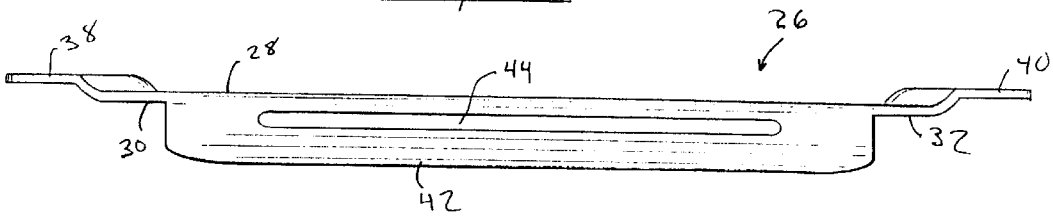
FIG. 5 is a top elevational view of a bracket according to the present invention.
Figure 6:
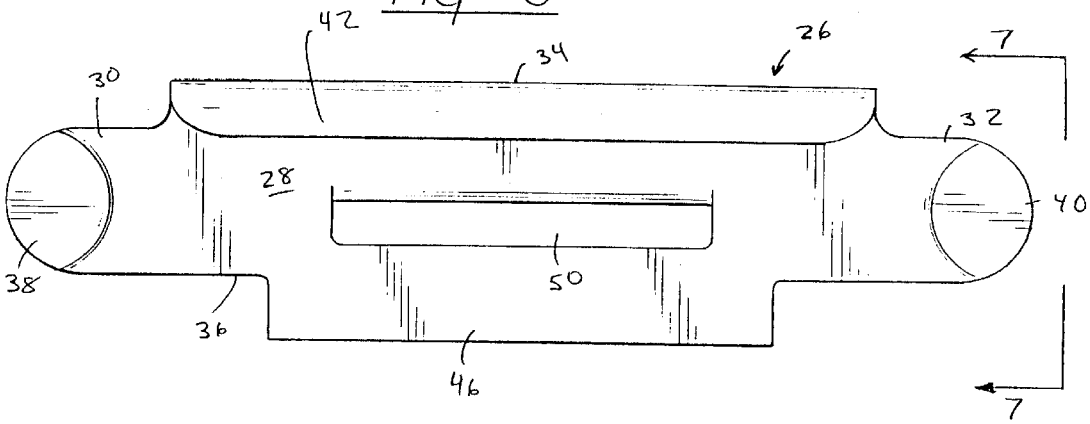
FIG. 6 is a side elevational view of the bracket of FIG. 5, showing the outward face of the bracket.
Figure 7:
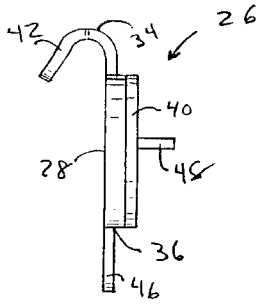
FIG. 7 is an elevational end view of the bracket of FIGS. 5 and 6 taken in the direction shown by lines 7—7 in FIG. 6.
Figure 8:
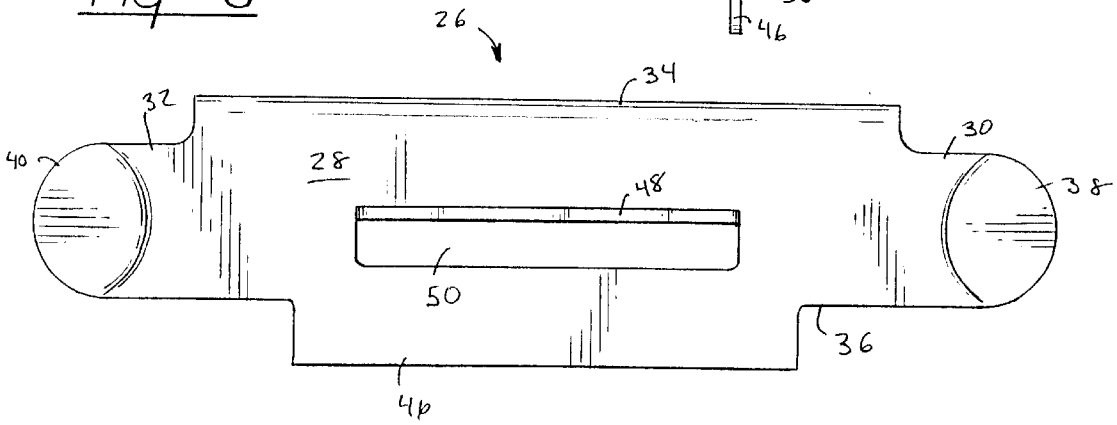
FIG. 8 is an elevational side view of the bracket of FIGS. 5–7, showing the inward face of the bracket.

For ease of reference, the bracket 28 may be said to have an outward face which is shown in FIG. 6 and an inward face which is shown in FIG. 8. When the bracket 28 is attached to a chair, the outward face faces outwardly from the chair while the inward face faces inwardly. As best shown in FIGS. 5 and 7, the attachment tabs 38 and 40 are offset inwardly somewhat from the plane of the planar body 28. Therefore, when the attachment tabs 38 and 40 are attached to the outer surface of the legs of the chair, as shown in FIG. 1, the remainder of the bracket 26 is positioned slightly outboard of the outer surface of the chair legs. This allows for easier attachment of one chair to a neighboring chair, as will be clear to those of skill in the art.

Referring again to FIGS. 5–8, the bracket 26 has a hook member 42 which extends from the first edge 34 of the planar body 28. The first edge 34 and hook member 42 are shown positioned on the upward side of the bracket 26. However, the bracket 26 may be inverted such that the first edge 34 is on the lower side of the bracket. That is, if the first attachment tab 38 is attached to a front leg of a chair and the second attachment tab 40 is attached to a rear leg on the same side, the first edge 34 will be an upward edge. However, the second attachment tab 40 may be attached to the front leg of a chair, and the first attachment tab 38 may be attached to the rear leg on the same side. In this orientation, the first edge 34 becomes the lower edge of the bracket and the second edge 36 becomes an upper edge. The orientation of the bracket 26 wherein the first edge 34 is the upper edge will be defined herein as the normal orientation, while the orientation wherein the first edge 34 is the lower edge will be described as the inverted orientation.

Referring again to FIG. 7, with the bracket 26 positioned in the normal orientation, it can be seen that the hook member 42 extends outwardly and downwardly from the first edge 34. As best shown in FIGS. 5 and 6, the hook member 42 is elongated, extending from almost the entire first edge 34 of the body 28. As best shown in FIG. 5, an elongated slot 44 is defined in the upper edge of the hook member 42. Therefore, the elongated slot 44 runs along the first edge 34 of the body 28.

An engagement tab 46 is defined at the second edge 36 of the body 28. Therefore, with the bracket 26 in the normal orientation, the engagement tab 46 extends downwardly. As best shown in FIG. 7, the tab 46 extends straight down from the remainder of the body 28 and is generally coplanar therewith. As shown, the engagement tab 46 is somewhat elongated, extending from a significant portion of the second edge 36. Preferably, the engagement tab 46 has a length just slightly less than the length of the slot 44 in the hook member 42.

As best shown in FIGS. 7 and 8, a stacking tab 48 extends inwardly from the planar body 28. Preferably, the stacking tab 48 extends perpendicularly inwardly from the planar body 28. The stacking tab 48 may be integral with the remainder of the bracket, or may be a separate piece. As shown in the figures, the stacking tab 48 is preferably integral with the remainder of the bracket and is formed by folding a portion of the planar body 28 inwardly to the perpendicular position. This leaves a slot 50 in the planar body 28 immediately below the stacking tab 48. This arrangement provides an efficient use of materials.

Referring again to FIGS. 1 and 2, the operation of brackets according to the present invention will be described. Preferably, a bracket is connected to the legs on one side of a chair in a normal orientation and an identical bracket is interconnected with the legs on the opposite side of the chair in the inverted orientation. The bracket 26 is shown interconnecting the front left leg 18 and rear left leg 20 on the left side of the chair 12, with the bracket 26 in its normal orientation. Therefore, a second bracket would be connected between the front right leg 22 and rear right leg 24 on the right side of the chair 12, with the second bracket in the inverted orientation.

Referring now to FIG. 2, a detail of the interconnection between the chairs 10 and 12 is shown. The left rear leg 52 of the chair 10 is shown positioned parallel to the right rear leg 24 of the chair 12. A first bracket 54 is interconnected with the left rear leg 52 and, though not shown, the left front leg of the chair 12. This first bracket 54 is positioned in the normal orientation. Therefore, the engagement tab 56 extends downwardly and the hook member 58 extends from the upper edge of the bracket 54. The slot 60 in the hook member 58 is also positioned at the upper edge of the bracket 54. A second bracket 62 is interconnected between the right rear leg 24 and the right front leg 22 of the chair 12. This second bracket 62 is positioned in the inverted orientation, with the engagement tab 64 extending upwardly and the hook member 66 and slot 68 being positioned at the downward edge of the bracket 62. As shown, the first bracket 54 and second bracket 62 are interlocked, thereby interconnecting the chairs 10 and 12. As shown, the hook member 58 of the first bracket 54 hooks over the engagement tab 64 of the second bracket 62 while the engagement tab 56 of the first bracket 54 is engaged by the hook member 66 of the second bracket 62.

Preferably, the engagement tab 56 of the first bracket 54 passes through the slot 68 in the hook member 66 of the second bracket 62. Also, the slot 60 in the hook member 58 of the first bracket 54 receives the engagement tab 64 of the second bracket 62. However, as will be clear to those of skill in the art, the engagement tabs 56 and 64 could be somewhat shortened and the slots 60 and 68 eliminated. Then, the hook members 58 and 66 would just pass around the shortened tabs, interlocking the brackets. Also, the engagement tabs 56 and 64 could be shaped differently than those shown. The slots 60 and 68 are preferred because they provide positive interconnection between the brackets 54 and 62. That is, once the engagement tabs slide into the corresponding slots, the chairs are very securely interlocked. Also, because the engagement tabs are preferably just slightly less elongated than the corresponding slots, the slots and tabs strictly limit forwardly and rearwardly relative movement between adjacent interlocked chairs. Therefore, two interlocked chairs, as shown in FIG. 1, will be very precisely aligned side by side. Also, as will be clear to those of skill in the art, the bracket design positions the chairs parallel to one another and limits how much out of parallel the chairs may become. Therefore, a row of chairs interlocked using brackets according to the present invention will be very precisely aligned, giving a neat appearance. The positive interlock also causes the chairs to tip together if one chair is knocked over. This is desirable for some applications.

To interlock a pair of chairs side by side, the chair with the bracket in the normal orientation is lifted upwardly until the engagement tab passes over the edge of the hook member on the other bracket. At the same time, the edge of the hook member on the lifted chair should pass over the upper edge of the engagement tab on the other bracket. The lifted chair may then be lowered until the tabs on each bracket engage the slots in the corresponding bracket. This engagement motion is shown by the phantom lines in FIG. 2.

Figure 3:
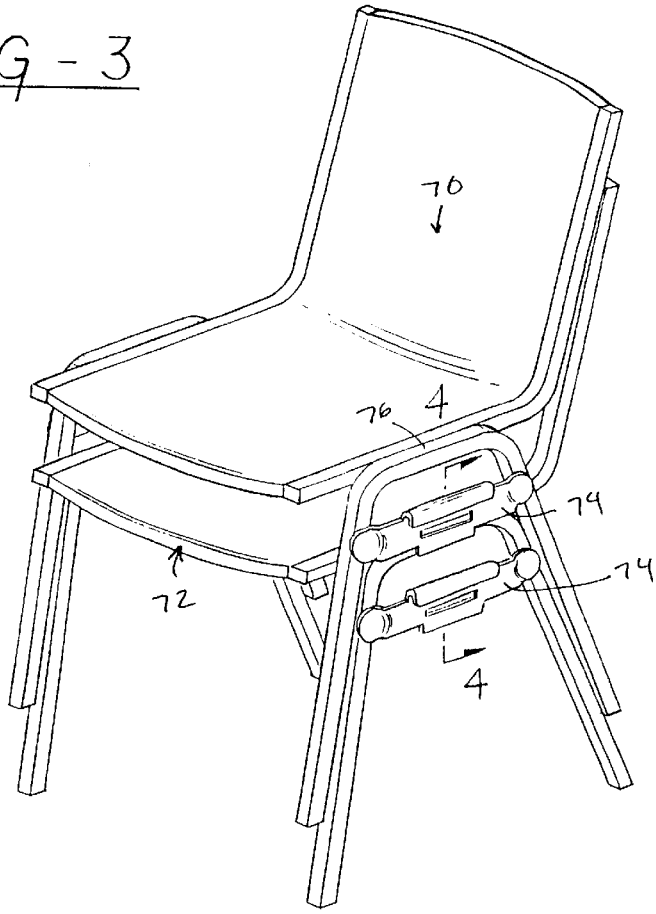
FIG. 3 is a perspective view of a pair of chairs including brackets according to the present invention, with the chairs in a stacked configuration.
Figure 4:
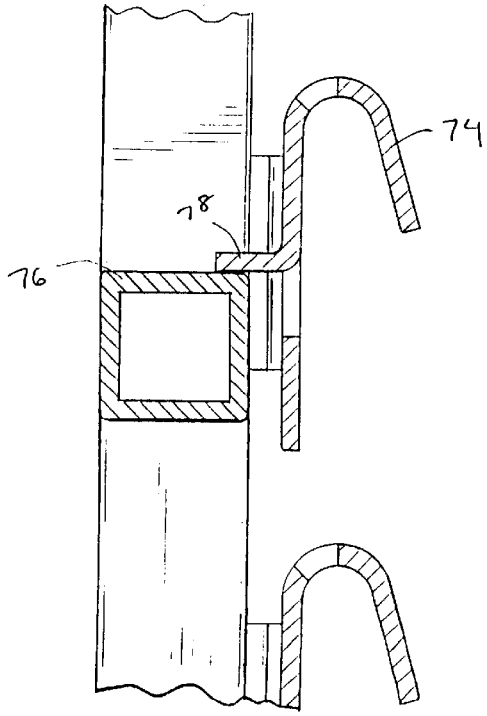
FIG. 4 is a cross-sectional view taken along lines 4—4 in FIG. 3 showing the operation of a bracket according to the present invention when chairs are stacked.

Referring now to FIGS. 3 and 4, a secondary function of the brackets according to the present invention will be described. As shown in FIG. 3, chairs for many uses preferably may be stacked, one on top another. In FIG. 3, an upper chair 70 is stacked atop a lower chair 72. Both chairs 70 and 72 have brackets 74 interconnecting front legs and rear legs on each side of the chair. Typically, chairs of this type have some type of frame member 76 which extends between each front and rear leg. In the illustrated embodiment, the frame member 76 on the upper chair 70 is a portion of the leg assembly interconnecting the front left leg and the rear left leg. The frame member 76 is level with and outboard of the seating surface of the chair 70. In other designs, a portion of the edge of the seating surface may form the frame member, as defined for purposes of this invention. As best shown in FIG. 4, the bracket 74 has an inwardly extending stacking tab 78, as was previously described. With the chairs in the stacked configuration, the stacking tab 78 of the bracket 74 on the upper chair 70 rests atop the frame member 76 of the lower chair 72. This provides several advantages. First, the stacking tab 78 provides a solid and level ledge which securely engages the frame member below it, thereby creating a consistent and stable stack of chairs. Secondly, this arrangement prevents the chair legs of the upper chair 70 from being forced too far downwardly about the legs of the lower chair 72. This helps to avoid the upper chair becoming wedged onto the lower chair. As will be clear to those of skill in the art, the stacking tabs on the brackets may be made in other configurations than those shown. For example, for some chair designs, the stacking tab may preferably extend further inwardly so as to engage a frame member that is positioned differently than those shown. Also, the stacking tab may have a somewhat different shape, such as a curved lower surface, to facilitate stacking. Other configurations will be apparent to those of skill in the art.

One embodiment of a combination stiffener and ganger bracket according to the present invention has been described and illustrated herein. However, variations on the illustrated and described embodiments which do not depart from the teachings of the present invention will be readily apparent to those of skill in the art. It is the following claims, including all equivalents, which define the scope of this invention.

We claim:

1. A chair comprising:

a generally horizontal seating surface;

four legs extending downwardly from said generally horizontal seating surface, said legs comprising a front left leg, a rear left leg, a front right leg, and a rear right leg;

a first combination stiffener and ganger bracket extending between and interconnecting said front left leg and said rear left leg;

a second combination stiffener and ganger bracket extending between and interconnecting said front right leg and said rear right leg;

each of said brackets having a generally planar body with a first attachment tab at a first end and a second attachment tab at a second end opposite said first end, a hook member extending from a first edge of said body, said first edge extending between said first and second ends, an engagement feature defined on a second edge of said body, said second edge extending between said first and second ends;

one of said brackets being attached to said front and rear legs such that said first edge of said body is upward; and the other of said brackets being attached to said front and rear legs such that said first edge of said body is downward.

2. A chair according to claim 1, wherein said first and second brackets are identical.

3. A chair according to claim 1, wherein said first and second brackets are both generally horizontal and generally parallel to said seating surface.

4. A chair according to claim 1, wherein said hook members further comprise slots defined therein.

5. A chair according to claim 1, wherein said engagement feature comprises a generally flat engagement tab.

6. A chair according to claim 1, wherein at least one of said attachment tabs is offset from the plane of said body.

7. A chair according to claim 1, wherein said engagement feature comprises a generally flat engagement tab and said hook members further comprise slots defined therein for receiving the engagement tab of another like bracket.

8. A chair according to claim 1, wherein each of said brackets further comprise a stacking tab projecting from the plane of said body.

9. A chair according to claim 8, wherein said stacking tab projects generally perpendicular to the plane of said body.

10. A chair according to claim 8, wherein said generally planar body is defined to have an outward face and an inward face, said hook member extending outwardly and said stacking tab extending inwardly from said body.

11. A chair comprising:

a generally horizontal seating surface;

four legs extending downwardly from said generally horizontal seating surface, said legs comprising a front left leg, a rear left leg, a front right leg, and a rear right leg;

substantially identical first and second ganger brackets each having a generally planar body with a first end and a second end opposite said first end, a hook member extending from a first edge of said body, said first edge extending between said first and second ends;

said first ganger bracket extending between and interconnecting said front left leg and said rear left leg;

said second ganger bracket extending between and interconnecting said front right leg and said rear right leg;

one of said ganger brackets connected to said legs such that said first edge is an upper edge; and the other of said ganger brackets connected to said legs such that said first edge is a lower edge.

12. A chair according to claim 11, wherein said first and second brackets are both generally horizontal and generally parallel to said seating surface.

13. A chair according to claim 11, wherein each of said ganger brackets further comprises a first attachment tab at said first end and a second attachment tab at said second end, at least one of said attachment tabs being offset from the plane of said body.

14. A chair according to claim 11, wherein each of said brackets further comprises a generally flat engagement tab extending from a second edge of said body, said second edge extending between said first and second ends of said body, said hook members further comprising slots defined therein for receiving the engagement tab of another like bracket.

15. A chair according to claim 11, wherein each of said brackets further comprises a stacking tab projecting from the plane of said body.

16. A chair according to claim 15, wherein said stacking tab projects generally perpendicular to the plane of said body.

17. A chair according to claim 15, wherein said generally planar body is defined to have an outward face and an inward face, said hook member extending outwardly and said stacking tab extending inwardly from said body.

18. A chair comprising:

a generally horizontal seating surface;

four legs extending downwardly from said generally horizontal seating surface, said legs comprising a front left leg, a rear left leg, a front right leg, and a rear right leg;

substantially identical first and second ganger brackets each having a generally planar body with a first end and an opposite second end with a first edge extending between said first and second ends, each of said brackets further having a stacking tab projecting from the plane of said body;

said first ganger bracket extending between and interconnecting said front left leg and said rear left leg;

said second ganger bracket extending between and interconnecting said front right leg and said rear right leg;

one of said ganger brackets connected to said legs such that said first edge is an upper edge; and the other of said ganger brackets connected to said legs such that said first edge is a lower edge.

19. A chair according to claim 18, wherein said first and second brackets are both generally horizontal and generally parallel to said seating surface.

20. A chair according to claim 18, wherein each of said ganger brackets further comprises a first attachment tab at said first end and a second attachment tab at said second end, at least one of said attachment tabs being offset from the plane of said body.

21. A chair according to claim 18, wherein each of said brackets further comprises a hook member extending from said first edge of said body and a generally flat engagement tab extending from a second edge of said body, said hook member further comprising a slot defined therein for receiving the engagement tab of another like bracket.

22. A chair according to claim 18, wherein said generally planar body is defined to have an outward face and an inward face, said stacking tab extending inwardly from said body.

* * * * *